US007048647B2

(12) United States Patent
Burrows

(10) Patent No.: US 7,048,647 B2
(45) Date of Patent: May 23, 2006

(54) IRON TYPE GOLF CLUB HEAD WITH SPATIALLY LAMINATED WEIGHTS

(75) Inventor: Bruce D. Burrows, Valencia, CA (US)

(73) Assignee: BGI Acquistions,LLC, Indianapolis, IA (US)

( * ) Notice: Subject to any disclaimer, the term of this patent is extended or adjusted under 35 U.S.C. 154(b) by 0 days.

(21) Appl. No.: 10/964,952

(22) Filed: Oct. 13, 2004

(65) Prior Publication Data

US 2005/0090332 A1 Apr. 28, 2005

Related U.S. Application Data

(60) Provisional application No. 60/537,836, filed on Jan. 20, 2004, provisional application No. 60/514,066, filed on Oct. 24, 2003.

(51) Int. Cl.
*A63B 53/04* (2006.01)
*A63B 53/06* (2006.01)

(52) U.S. Cl. ..... 473/334; 473/349; 473/350; 473/335

(58) Field of Classification Search ..... 473/324–350
See application file for complete search history.

(56) References Cited

U.S. PATENT DOCUMENTS

| | | | | | |
|---|---|---|---|---|---|
| 1,320,163 | A | | 10/1919 | Maurice | |
| 4,540,178 | A | | 9/1985 | Johnson et al. | |
| 4,811,950 | A | | 3/1989 | Kobayashi | |
| 5,297,794 | A | * | 3/1994 | Lu | 473/337 |
| 5,439,223 | A | * | 8/1995 | Kobayashi | 473/334 |
| 5,492,327 | A | * | 2/1996 | Biafore, Jr. | 473/332 |
| 5,564,705 | A | * | 10/1996 | Kobayashi et al. | 473/334 |
| 5,584,770 | A | * | 12/1996 | Jensen | 473/350 |
| 5,593,356 | A | * | 1/1997 | Takeda | 473/335 |
| 5,613,917 | A | * | 3/1997 | Kobayashi et al. | 473/335 |
| 5,669,826 | A | * | 9/1997 | Chang et al. | 473/332 |
| 5,833,551 | A | * | 11/1998 | Vincent et al. | 473/350 |
| 6,059,669 | A | * | 5/2000 | Pearce | 473/339 |
| 6,095,931 | A | | 8/2000 | Hettinger et al. | |
| 6,117,022 | A | | 9/2000 | Crawford et al. | |
| 6,328,661 | B1 | | 12/2001 | Helmstetter et al. | |
| 6,336,869 | B1 | | 1/2002 | Hettinger et al. | |
| 6,368,232 | B1 | | 4/2002 | Hamada et al. | |
| 6,478,690 | B1 | | 11/2002 | Helmstetter et al. | |
| 6,524,196 | B1 | | 2/2003 | Yeh | |
| 6,688,989 | B1 | * | 2/2004 | Best | 473/332 |
| 6,773,361 | B1 | * | 8/2004 | Lee | 473/335 |
| 2001/0001774 | A1 | * | 5/2001 | Antonious | 473/349 |
| 2002/0042307 | A1 | * | 4/2002 | Deshmukh | 473/335 |
| 2002/0065144 | A1 | | 5/2002 | Helmstetter et al. | |
| 2005/0054458 | A1 | * | 3/2005 | Chen | 473/291 |

* cited by examiner

*Primary Examiner*—Sebastiano Passaniti
(74) *Attorney, Agent, or Firm*—Ice Miller LLP; Doreen Gridley; David Quick

(57) ABSTRACT

An iron type golf club head includes a plurality of weights mounted at a rear side thereof in a spatially laminated array. The club head includes a front impact face oriented at a selected loft angle for striking a golf ball, and a rear side having an integrally formed weight frame protruding rearwardly therefrom. The weight frame defines a plurality of peripheral or perimeter grooves disposed in generally fore-aft spaced relation and adapted to receive and support weights of selected mass. In a preferred form, each weight includes one or more weight elements seated within the associated groove to wrap substantially about the entire periphery of the weight frame, with an outboard marginal edge of each weight element being visible from the exterior of the club head. Abutting ends of the weight element or elements within each groove may be interconnected end-to-end as by welding.

24 Claims, 4 Drawing Sheets

FIG. 8
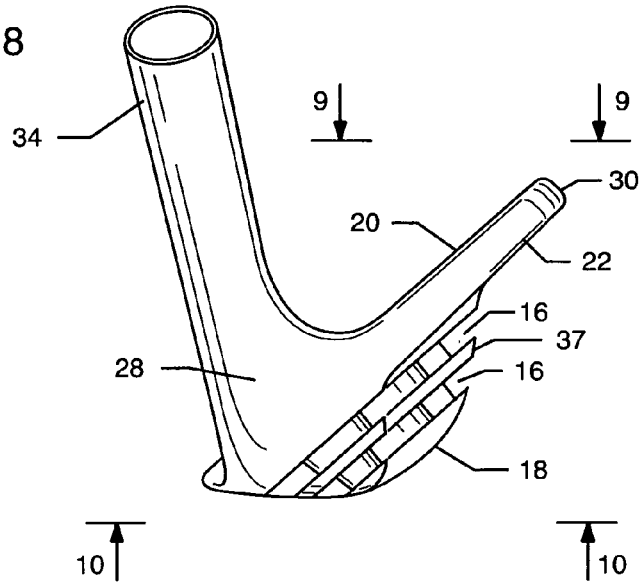
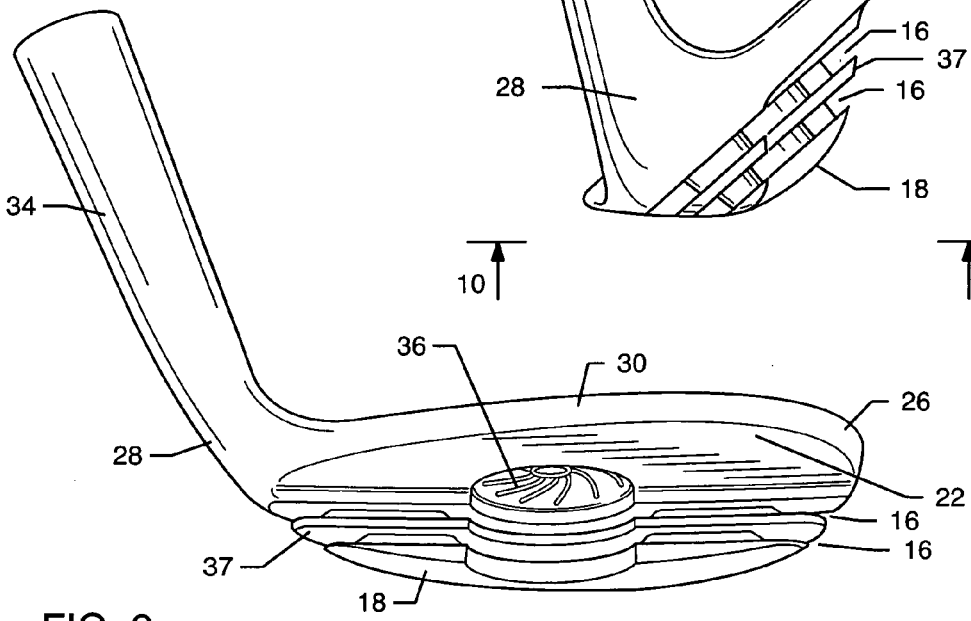
FIG. 9
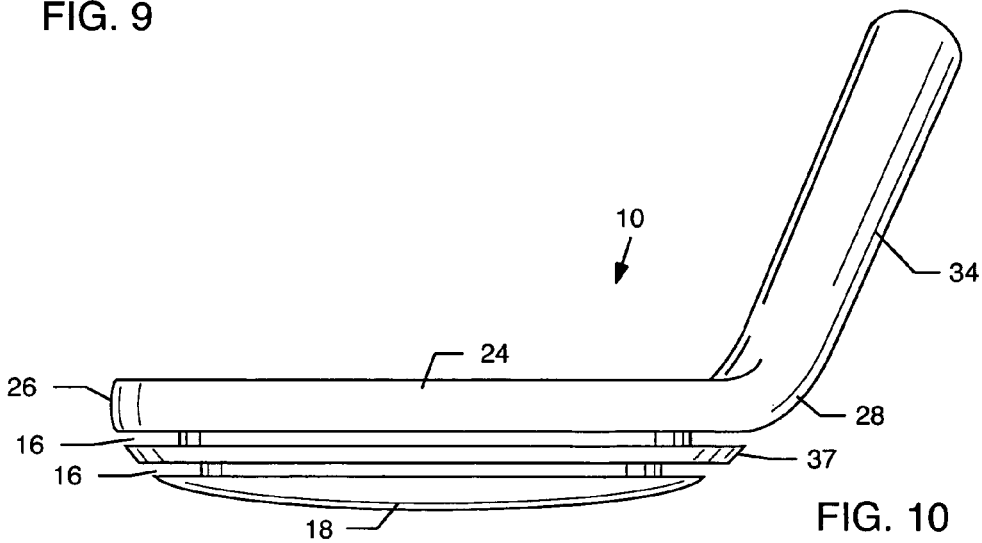
FIG. 10

IRON TYPE GOLF CLUB HEAD WITH SPATIALLY LAMINATED WEIGHTS

This application claims the benefit of U.S. Provisional Application 60/514,066, filed Oct. 24, 2003, and U.S. Provisional Application 60/537,836, filed Jan. 20, 2004.

BACKGROUND OF THE INVENTION

This invention relates generally to improvements in golf club heads of the so-called iron type. More particularly, this invention relates to an improved iron type golf club head having a unique weighting system with one or more weights mounted at a rear side of the club head, wherein the improved weighting system is particularly suitable for customized club adaptation to suit the needs and preferences of an individual golfer, and further wherein the assembled club head has an attractive and highly distinctive appearance.

Iron type golf club heads are generally known in the art, wherein a blade-like structure is formed from a suitable cast or forged metal to include a front side defining an impact face or faceplate for striking a golf ball. This blade-like structure further includes a hosel formed at a heel end thereof for connection to the lower end of a golf club shaft. The faceplate is oriented at a selected inclination or loft angle for imparting a desired degree of loft to a golf ball, and a shallow groove pattern is commonly formed in the faceplate for enhanced engagement with the golf ball on impact. A typical set of golf clubs includes multiple iron type clubs each having a faceplate oriented at a different loft angle, e.g., iron type clubs commonly referred to by number as "1" through "9" irons, or as a pitching or sand wedge, etc., wherein the golfer may select a specific club in accordance with the loft and distance desired for a particular golf shot.

In many iron type club heads, the rear side of the club head incorporates a contoured or rearwardly protruding geometry intended to control and improve the club head weighting. In particular, the rear side of the club head may incorporate a rearwardly protruding flange or rib which may extend along a rear side lower margin of the club head to lower the overall club head center of gravity, or alternately extend around the entire perimeter of the club head rear side. Such rearwardly protruding weight elements, which are typically cast or forged as an integral component of the club head, are intended to provide improved control during a golf shot to achieve improved consistency and accuracy of ball travel distance and direction. Integrally formed weight elements, however, are not readily conducive to custom-adaptation to suit the needs and preferences of an individual golfer.

Toward this end, modified iron type golf club heads have been developed for assembly with one or more separately provided weight elements, typically by means of welding or brazing, or by use of a suitable adhesive such as a selected epoxy or the like, or by means of one or more fasteners such as pins and screws. While these multi-part club heads beneficially accommodate customized club head weighting, the look and feel of such club heads has not gained widespread favor or acceptance among golfers. In some instances, the weight elements have tended to loosen over a period of time in response to shock forces occurring upon each impact with a golf ball, resulting in an undesirable tactile feel and an undesirable audible feedback. Moreover, for many golfers, there is a fear that one or more of the separately mounted weight elements may unexpectedly separate from and fly off the club head during a golf shot.

There exists, therefore, a need for further improvements in and to iron type golf club heads, particularly with respect to providing a head construction suitable for assembly with one or more custom-selected weight elements in a manner that is highly secure and stable, and further in a manner that presents a highly desirable look and feel to the golf club. The present invention fulfills these needs and provides further related advantages.

SUMMARY OF THE INVENTION

In accordance with the invention, an improved iron type golf club head and related assembly method are provided wherein the club head supports at least one and preferably a plurality of weights or weight elements mounted at a rear side thereof. The rear side of the club head includes an integrally formed and rearwardly protruding weight frame defining at least one groove formed to extend substantially and preferably entirely about a perimeter or periphery thereof, for seated reception of at least one weight therein. A preferred club head construction includes at least two of said grooves arranged generally in fore-aft spatial array, for correspondingly receiving and supporting respective weights therein. Abutting ends of the weights seated within these grooves are securely interconnected, as by welding or soldering, and the thus-mounted weights define outboard marginal edges that are visibly exposed from the exterior of the club head.

In a preferred form of the invention, a plurality of weights each having a different selected mass are provided for seated installation into the associated groove or grooves formed in the weight frame protruding rearwardly from the rear side of the club head. Each weight may be subdivided into a plurality of two or more weight elements adapted for relatively close-fit and preferably press-fit reception into the associated groove, with abutting ends of the multiple weight elements securely interconnected to each other as by welding or soldering. Adhesive means such as a suitable epoxy may be additionally employed for securely locking and retaining the weight elements within their respective grooves, substantially without relative motion or wobble with respect to the club head. With this construction, weight elements of different selected mass may be chosen by a specific golfer for seated assembly with the associated weight frame groove of the club head.

Each installed weight defines an outboard margin that is visible within its associated weight frame groove, from the exterior of the club head. In addition, in a preferred form, the weights and/or weight elements are provided in a color or colors different from the club head including the weight frame, thereby providing a distinctive multi-color appearance to the assembled club head. By way of example, the weight or weight elements may be formed from an alloy including components such as brass or copper to provide yellow or reddish color tones that visibly stand out relative to the typically silver or gray of a club head formed from stainless steel or titanium alloy or the like.

Other features and advantages of the invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 8 is a heel end elevation view of the golf club head shown in FIG. 7, without the weights mounted thereon;

FIG. 9 is an upper plan view of the golf club head shown in FIGS. 7–8, without the weights mounted thereon, taken generally on the line 9—9 of FIG. 8; and FIG. 10 is a lower plan view of the of the golf club head shown in FIGS. 7–8, without the weights mounted thereon, taken generally on the line 10—10 of FIG. 8.

DETAILED DESCRIPTION OF THE PREFERRED EMBODIMENTS

Figure 1:
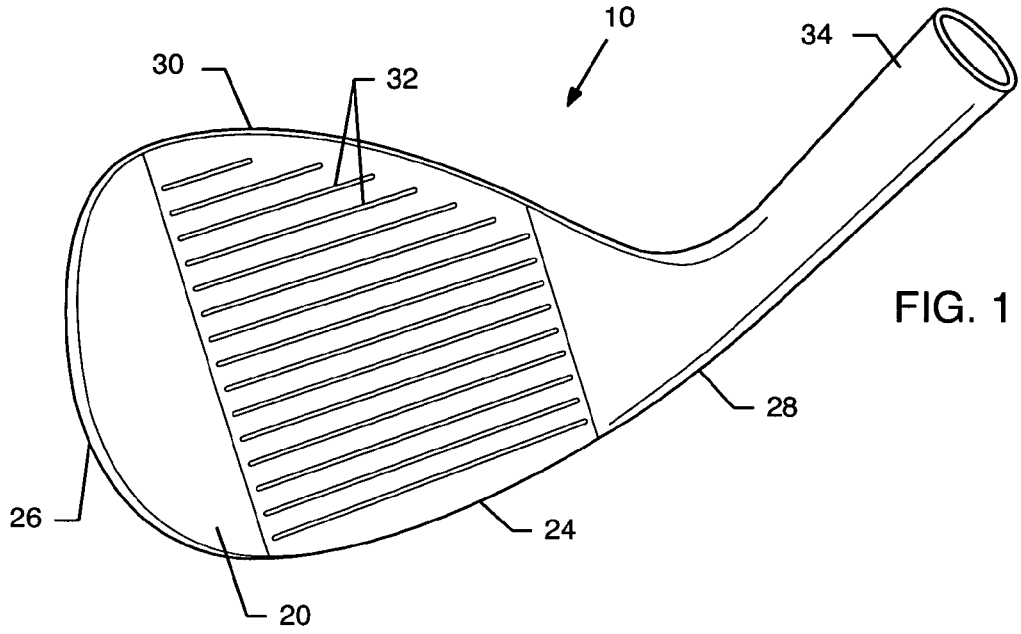
FIG. 1 is a front perspective view of an iron type golf club head which may incorporate spatially laminated weights in accordance with the present invention.
Figure 2:
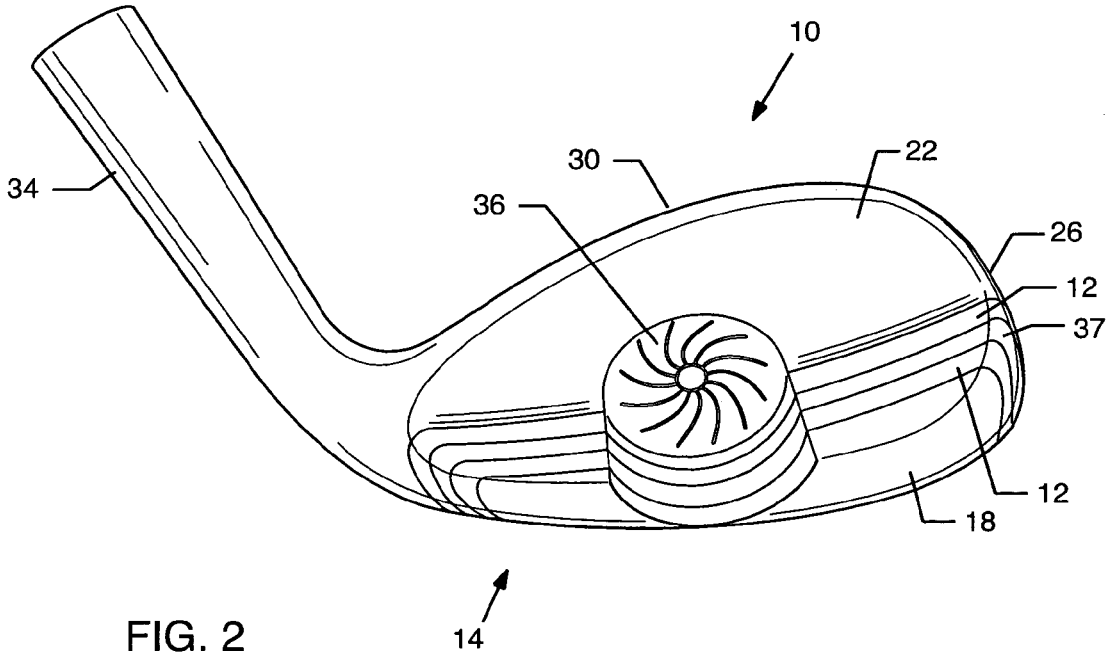
FIG. 2 is a rear elevation view of the golf club head shown in FIG. 1, and illustrating a pair of spatially laminated weights mounted at a rear side of the golf club head.
Figure 3:
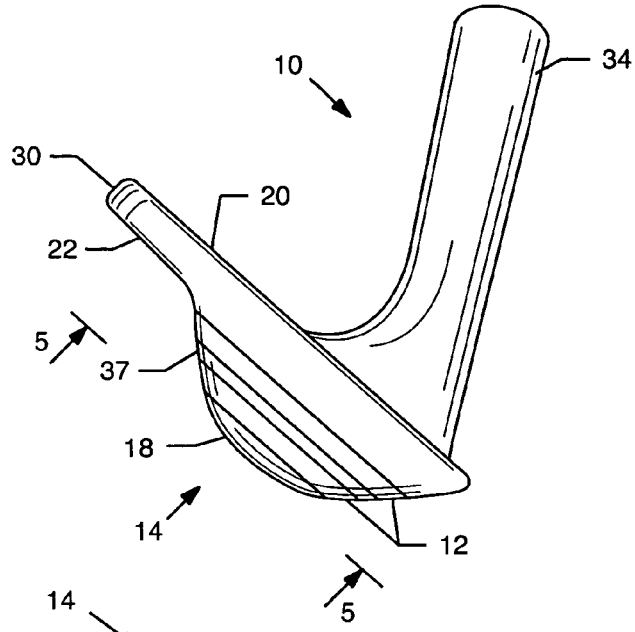
FIG. 3 is a toe end elevation view of the golf club head of FIGS. 1 and 2.
Figure 4:
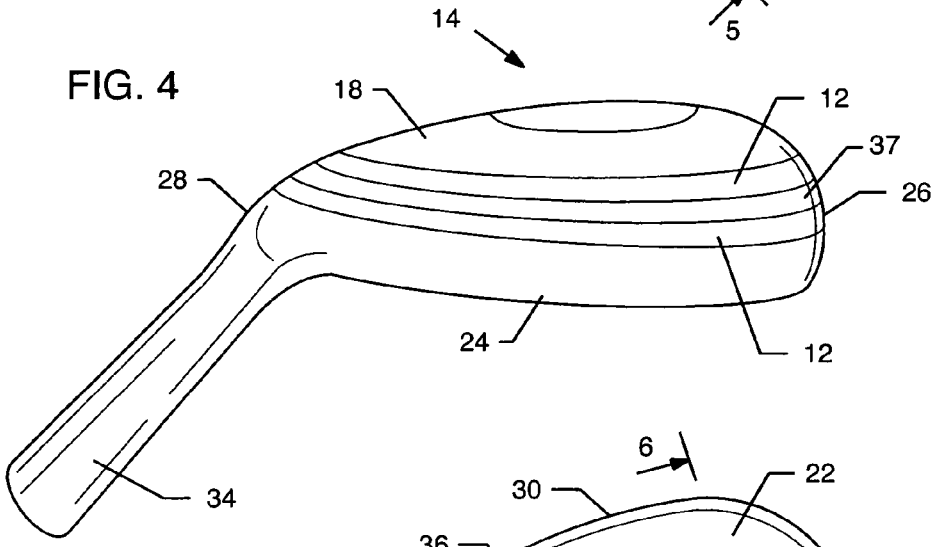
FIG. 4 is a bottom plan view of the golf club head of FIGS. 1–3.
Figure 5:
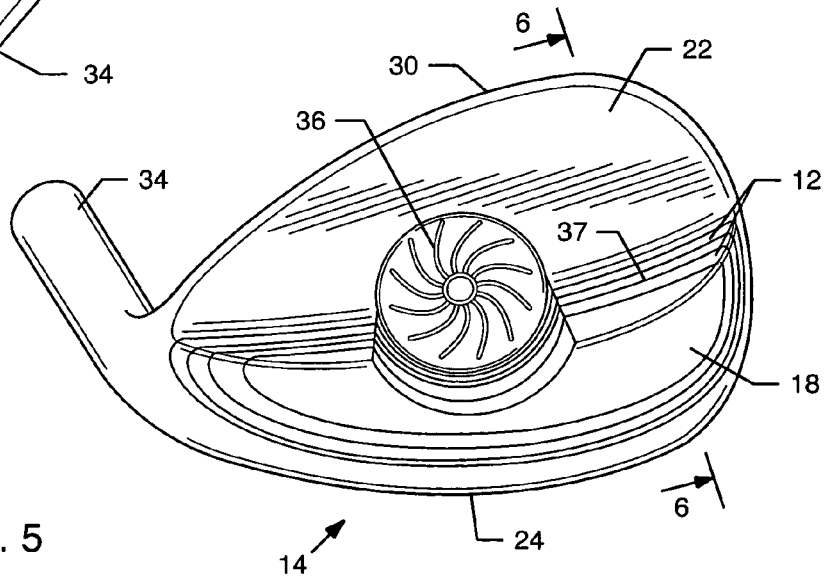
FIG. 5 is a plan view showing the rear side of the golf club head, taken generally on line 5—5 of FIG. 3.
Figure 6:
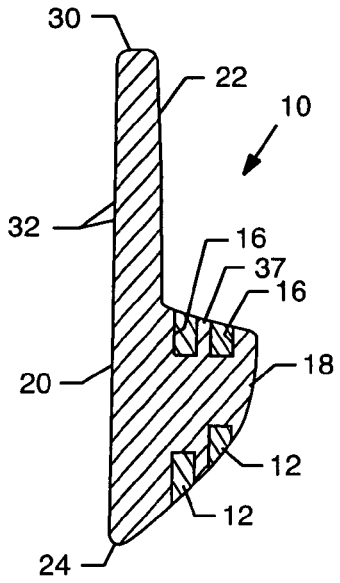
FIG. 6 is an enlarged fragmented sectional view taken generally on the line 6—6 of FIG. 5.
Figure 7:
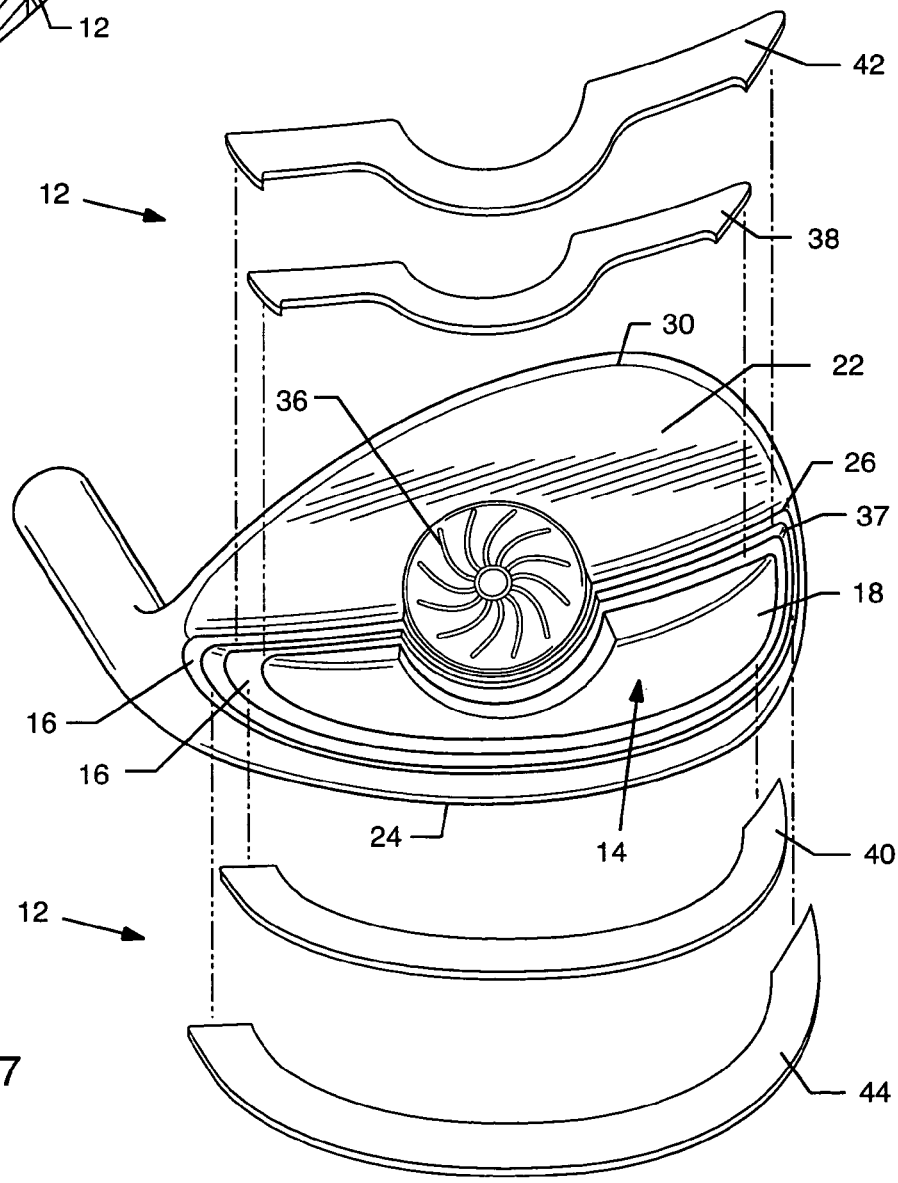
FIG. 7 is an exploded rear side perspective view showing a plurality of weights in exploded relation with the golf club head.

As shown in the exemplary drawings, an improved iron type golf club head referred to generally in FIGS. 1–10 by the reference numeral 10 includes a plurality of weights 12 (FIGS. 2–7) mounted securely in a spatially laminated array at a rear side 14 thereof. These weights 12 are seated and retained within a corresponding spaced-apart array of peripheral or perimeter grooves 16 (shown best in FIGS. 6–10) formed in a weight frame 18 formed integrally with and protruding rearwardly from the rear side of the golf club head 10.

In one preferred form as shown, the iron type golf club head 10 generally comprises a blade-shaped structure or body formed from a selected metal such as titanium, titanium alloy, stainless steel, or the like and shaped as by forging or casting to include a front side defining the a ball impact face or faceplate 20 (shown best in FIG. 1). The rear side 14 of the club head body is defined by a generally planar rear face 22 in combination with the rearwardly protruding weight frame 18 as will be described in more detail herein. The faceplate 20 and the rear side 14 are bounded by and thus cooperatively form a lower sole edge 24, a toe end 26, a heel end 28, and an upper edge 30. The faceplate 20 may include an array or pattern 32 of shallow recesses (FIG. 1) for improved or controlled engagement with a golf ball (not shown) upon impact therewith during a golf shot. A tubular hosel 34 extends generally upwardly at a selected angle from the heel end 28 of the club head 10 for suitable connection to the lower end of a golf club shaft (not shown) in a manner known in the art.

The blade-shaped club head body including the front faceplate 20 is oriented at a selected inclination or loft angle for imparting a desired degree of loft to a golf ball. In this regard, a typical set of golf clubs will include multiple iron type clubs each having a faceplate 20 oriented at a different loft angle, e.g., iron type clubs selected from the group commonly referred to by number as "1" through "9" irons, or as a pitching or sand wedge, etc. For a particular golf shot, the golfer will select a specific one of these clubs in accordance with the loft and distance desired for advancing the golf ball toward the cup on the golf green. Persons skilled in the art will recognize and appreciate that the exemplary drawings depict the club head 10 oriented at one loft angle, but that the invention herein is applicable to any iron type golf club head.

As shown in FIGS. 2–6, the rearwardly protruding weight frame 18 receives and supports at least one and preferably multiple weights 12 in a generally fore-aft spaced-apart array at the rear side of the club head 10. In this regard, the illustrative drawings show the weight frame 18 formed as an integral component with the blade structure of the club head, to protrude rearwardly therefrom in the form of an elongated rearwardly bulged flange extending generally along the lower sole edge 24 thereof. With this construction, the weight frame 18 in combination with the weights 12 carried thereby has a center of gravity disposed vertically below a centerline or center of gravity of the remainder of the club head, thereby providing the overall club head with an overall lowered center of gravity. Alternately, persons skilled in the art will understand that the position and shape of the weight frame 18 may vary, as by forming the weight frame with a closed loop configuration protruding rearwardly from the perimeter of the club head rear side 14. A portion of the club head rear face 22, particularly in a central region aligned generally with a sweet spot on the opposite faceplate 20 for optimal ball impact, preferably remains rearwardly exposed and may incorporate surface contour such as a manufacturer's identification mark or logo 36.

The weight frame 18 defines the at least one and preferably multiple grooves 16, and each of which extends substantially and preferably entirely around the perimeter or periphery of the frame in a radially outwardly open, fore-aft spaced-apart and generally parallel array. That is, as viewed best in FIGS. 6–10 in the exemplary embodiment of the invention, two of these perimeter grooves 16 are formed in the weight frame 18, wherein these grooves are spatially separated by an intervening flange 37 formed integrally with the weight frame 18. A corresponding pair of the weights 12 are respectively seated and securely retained within these perimeter grooves 16, with the weights 12 defining outboard marginal edges shaped and positioned to coincide substantially with the adjacent external surface geometry of the weight frame 18. With this construction, the outboard marginal edges of the weights 12 are visible from the exterior of the assembled golf club head 10, and separated by the intervening flange 37, to provide a distinctive and attractive laminated appearance. This club head appearance is enhanced by forming one or both of the weights 12 from a material that contrasts in color with the color and/or surface finish of the cast or forged blade structure and related weight frame 18. In one example, one of the weights 12 incorporates reddish tones such as copper and the other weight 12 incorporates yellow tones such as brass, with the balance of the club head being formed from a polished silver or gray metal alloy.

Each weight 12 has a size and shape for substantially mated and seated reception into the associated weight frame groove 16, for substantially filling the groove volume without residual unfilled space or voids. In this regard, as viewed in FIG. 7, each weight 12 may comprise a plurality of weight elements such as the illustrative first pair of weight elements 38 and 40 sized for mating, substantially close-fit or press-fit reception into the inboard groove 16 disposed closer to the rear face 22, and the illustrative second pair of weight elements 42 and 44 for similar close-fit or press-fit reception into the outboard groove 16 disposed closer to the rearmost or free end of the weight frame 18. These pairs or sets of weight elements 38, 40 and 42, 44 are pre-shaped to seat in substantially end-to-end abutting relation within the associated weight frame groove 16, to substantially fill said groove, and for convenient interconnection of the abutting ends of the weight elements as by means of welding or soldering or the like. Such attachment of the abutting ends of the weight elements securely retains the thus-assembled weights 12 within the weight frame grooves 16, substantially without concern for unexpected and undesired separation from the club head during a golf swing. In addition, welded attachment of the abutting ends beneficially permits welding of similar metal materials, and thereby avoids potentially inferior strength connections using dissimilar materials. Soldered attachment of the abutting ends beneficially provides a secure connection with wick inflow into a small crevice or space between closely interfitting abutting ends of the weight elements.

The specific shapes of each end-abutting pair of weight elements can be varied as desired to adjust the specific location of the connection interface. In this regard, it may be desirable to shift the connection interface between end-abutting weight elements to a location spaced from a high stress zone upon club head impact with a golf ball during normal club use.

The weights 12 may take alternative forms, including but not limited to a single elongated weight element adapted for seated wrapping within the associated weight frame groove, and substantially abutting opposite ends disposed for secure interconnection as described above. Alternately, or in addition, a suitable epoxy or the like may be used for retaining the weight or weight elements withing the associated groove 16, or the weights may be formed by filling the grooves 16 with an epoxy or polymer loaded with a selected mass of heavier particles such as metal, e.g., a tungsten filled polyurethane or the like. In some designs, each weight 12 can be firmly retained within the associated groove 16 by press-fit connection with the weight 12 suitably forced into the groove 16 by hammering or the like. In other alternative designs, the club head including the weight frame 18 with one or more grooves 16 formed therein may be used as a mold insert to accommodate molding as by injection, or direct pouring or casting of weight-forming material directly into each groove 16. Still further, in some designs, the abutting ends of each weight 12 can be shaped for mechanical interlock in lieu of or in addition to welded or soldered or adhesive interconnection as described above.

As a further alternative, one or more of the grooves 16 may be formed with a discontinuous configuration, i.e., an interrupted groove defining multiple groove segments each adapted to receive individual weights or weighted material therein.

In the preferred embodiment of the invention, the abutting ends of a weight element or elements within each weight frame groove 16 are securely interconnected, with resultant retention forces supplemented by press-fit mounting of the weight element or elements into the associated groove 16, and further including an epoxy adhesive or the like to prevent component vibration or other movement of the weight or weight elements relative to the blade-shaped body during a golf shot. With this preferred construction, the resultant golf club head 10 has a solid look and a solid tactile feel and sound.

In accordance with one aspect of the invention, the weights 12 are provided in a range of different specific mass for individual selection according to the need and preferences of an individual golfer. That is, specific weights 12 for each of the two illustrative fore-aft spaced grooves 18 are chosen by the golfer to provide a custom-weighted golf club head 10.

A variety of modifications and improvements in and to the improved iron type golf club head of the present invention will be apparent to those persons skilled in the art. By way of example, it will be recognized that the rearwardly protruding weight frame 18 on the club head 10 may be defined by a single rearwardly protruding post-like structure as shown, or alternately by two or more spaced-apart rearwardly protruding posts which collectively define the peripheral groove or grooves 16, while additionally defining one or more intervening spaces which may also be filled with the weight-forming material. In addition, it will be appreciated that the integrally formed weight frame 18 as shown may be constructed from multiple components adapted for secure attachment to the rear side of the club head 10 in a stacked array, as by welding, to form the unitized club head/weight frame structure. Accordingly, no limitation on the invention is intended by way of the foregoing detailed description and accompanying drawings directed to a preferred embodiment of the invention, except as set forth in the appended claims.

What is claimed is:

1. An iron type golf club head, comprising:

a club head body having a front side defining a faceplate for impact engagement with a golf ball, and a rear side;

at least one rearwardly protruding weight frame on said rear side of said club head body, said weight frame defining at least a pair of outwardly open perimeter grooves each extending substantially about the periphery of said weight frame wherein said pair of grooves are formed generally in parallel with each other, said pair of perimeter groove being spatially separated by an intervening flange on said weight frame; and at least a pair of elongated weights respectively seated and retained within said pair of grooves, and externally visible therein.

2. An iron type golf club head, comprising:

a club head body having a front side defining a faceplate for impact engagement with a golf ball, and a rear side;

at least one rearwardly protruding weight frame on said rear side of said club head body, wherein said weight frame protrudes rearwardly from said club head body at a location disposed vertically below a center of gravity for the remainder of the said club head body, said weight frame defining at least one outwardly open perimeter groove extending substantially about the periphery thereof; and at least one weight seated and retained within said groove, and externally visible therein.

3. The iron type golf club head of claim 2 wherein said at least one perimeter groove comprises a pair of perimeter grooves each extending substantially about the periphery of said weight frame, said pair of perimeter groove being spatially separated by an intervening flange on said weight frame, and further wherein said at least one weight comprises a pair of elongated weights respectively seated and retained within said pair of grooves.

4. The iron type golf club head of claim 3 wherein said pair of weights are formed with different colors.

5. The iron type golf club head of claim 3 wherein said pair of weights are formed with a contrasting color relative to said weight frame.

6. The iron type golf club head of claim 3 wherein said pair of weights are formed with a contrasting surface finish relative to said weight frame.

7. The iron type golf club head of claim 2 wherein said weight frame is formed integrally with said club head body.

8. The iron type golf club head of claim 2 wherein said weight has a size and shape for substantially mated reception into said groove.

9. The iron type golf club head of claim 2 wherein said weight has a size and shape for substantially press-fit reception into said groove.

10. The iron type golf club head of claim 2 further including means for retaining said weight within said groove.

11. The iron type golf club head of claim 10 wherein said retaining means comprises a welded connection.

12. The iron type golf club head of claim 10 wherein said retaining means comprises a soldered connection.

13. The iron type golf club head of claim 10 wherein said weight is seated within said groove with free ends thereof in substantially end-to-end abutting relation, and further wherein said retaining means comprises means for interconnecting said free ends thereof.

14. The iron type golf club head of claim 10 wherein said retaining means comprises an adhesive connection.

15. The iron type golf club head of claim 2 wherein said weight comprises a plurality of weight elements each having a size and shape for substantially close-fit seated reception into said groove with free ends of said weight elements in substantially end-to-end abutting relation, and further including means for interconnecting said weight element free ends.

16. An iron type golf club head, comprising:

a club head body having a front side defining a faceplate for impact engagement with a golf ball, and a rear side;

a rearwardly protruding weight frame on said rear side of said club head body, said weight frame defining a plurality of outwardly open perimeter grooves formed generally in a front-to-rear spatially separated and generally parallel relation and each extending substantially about the periphery of said weight frame; and a plurality of weights seated and retained within said grooves, and externally visible therein.

17. The iron type golf club head of claim 16 wherein said weights are formed from at least two different colors.

18. The iron type golf club head of claim 16 wherein said weights are formed with a contrasting color relative to said weight frame.

19. The iron type golf club head of claim 16 wherein weights are formed with a contrasting surface finish relative to said weight frame.

20. The iron type golf club head of claim 16 wherein said weight frame is formed integrally with said club head body.

21. The iron type golf club head of claim 16 wherein each of said weights has a size and shape for substantially close-fit mated reception into an associated one of said grooves.

22. The iron type golf club head of claim 16 further including means for retaining said weights within said grooves.

23. The iron type golf club head of claim 22 wherein each of said weights has an elongated size and shape for seated reception into an associated one of said grooves with free ends thereof in substantially end-to-end abutting relation, and further wherein said retaining means comprises means for interconnecting said free ends thereof.

24. The iron type golf club head of claim 16 wherein said weight frame protrudes rearwardly from said club head body at a location disposed vertically below a center of gravity for the remainder of the said club head body.

* * * * *